US007383713B2

(12) United States Patent
Wouters

(10) Patent No.: US 7,383,713 B2
(45) Date of Patent: Jun. 10, 2008

(54) METHOD OF MANUFACTURING A CONSUMABLE FILLER METAL FOR USE IN A WELDING OPERATION

(75) Inventor: Huibrecht Adriaan Wouters, Leiden (NL)

(73) Assignee: Aleris Aluminum Koblenz GmbH, Koblenz (DE)

( * ) Notice: Subject to any disclaimer, the term of this patent is extended or adjusted under 35 U.S.C. 154(b) by 87 days.

(21) Appl. No.: 11/377,618

(22) Filed: Mar. 17, 2006

(65) Prior Publication Data

US 2006/0243016 A1 Nov. 2, 2006

Related U.S. Application Data

(60) Provisional application No. 60/666,599, filed on Mar. 31, 2005.

(30) Foreign Application Priority Data

Mar. 30, 2005 (EP) ..... 05075737

(51) Int. Cl.
*B21C 23/22* (2006.01)

(52) U.S. Cl. ..... 72/258; 72/256; 72/274; 72/700; 72/711

(58) Field of Classification Search ..... 72/47, 72/60, 253.1, 256, 258, 274, 700, 711
See application file for complete search history.

(56) References Cited

U.S. PATENT DOCUMENTS

| | | | | |
|---|---|---|---|---|
| 2,659,133 | A | 11/1953 | Leontis et al. | |
| 2,708,770 | A | 5/1955 | Herres et al. | |
| 3,205,692 | A * | 9/1965 | Kemppinen et al. | 72/264 |
| 3,795,970 | A * | 3/1974 | Keathley et al. | 29/423 |
| 3,841,127 | A * | 10/1974 | Pashak | 72/47 |
| 4,224,267 | A | 9/1980 | Lugosi et al. | |
| 4,462,234 | A * | 7/1984 | Fiorentino et al. | 72/41 |
| 4,494,448 | A * | 1/1985 | Eystratov et al. | 92/172 |
| 4,526,551 | A * | 7/1985 | Hoffmanner et al. | 445/7 |
| 4,575,343 | A * | 3/1986 | Kin et al. | 445/7 |
| 4,631,236 | A * | 12/1986 | Roczyn | 428/558 |
| 4,800,131 | A | 1/1989 | Marshall et al. | |
| 5,551,902 | A * | 9/1996 | Hubert et al. | 445/7 |
| 5,964,117 | A * | 10/1999 | Holroyd et al. | 72/258 |
| 6,363,608 | B1 * | 4/2002 | Koike et al. | 29/888.04 |
| 6,695,935 | B1 | 2/2004 | Haszler et al. | |
| 6,848,233 | B1 | 2/2005 | Haszler et al. | |

FOREIGN PATENT DOCUMENTS

| | | |
|---|---|---|
| GB | 635608 | 4/1950 |
| WO | 9942627 | 8/1999 |
| WO | 0066800 | 11/2000 |
| WO | 2006040034 | 4/2006 |

* cited by examiner

*Primary Examiner*—Ed Tolan
(74) *Attorney, Agent, or Firm*—Novak Druce + Quigg, LLP

(57) ABSTRACT

Method of manufacturing consumable filler metal wire, rod, or stick, and the like, of predetermined length and cross-section for use in welding, including: providing an ingot of a first metal and one or more different further metals; forming composite product by providing the ingot of the first metal with one or more hollow cores in substantially parallel relation to each other and locating in the hollow cores the different further metal or metals; applying pressure to the composite product to reduce its cross-section to a predetermined cross-section to form feedstock. Optionally further deforming the feedstock by mechanical pressure to form wire, rod or stick, of final cross-section so ultimate alloying of the first metal with the different further metal or metals occurs when the wire, rod or stick is used as filler material or consumable electrode during welding. Using this filler metal for welding an assembly of aluminium members.

42 Claims, No Drawings

METHOD OF MANUFACTURING A CONSUMABLE FILLER METAL FOR USE IN A WELDING OPERATION

CROSS-REFERENCE TO RELATED APPLICATIONS

This claims the benefit under 35 USC 119 of U.S. provisional patent application No. 60/666,599, filed Mar. 31, 2005, to Wouters et al. and this claims priority under 35 USC 119 from European patent application no. 05075737.6, filed Mar. 30, 2005, both incorporated herein by reference in their entirety.

FIELD OF THE INVENTION

The invention relates to a method of manufacturing a consumable filler metal, preferably in the form of wire, rod, or stick, and the like, of predetermined length and cross-section for use in a welding operation, preferably for welding aluminium alloys. The invention further relates to the use of the filler metal obtained by the method of this invention for welding an assembly of aluminium members.

The alloy members used herein are in accordance with the well-known aluminium alloy product standards of the Aluminum Association. All percentages are in weight percents, unless otherwise indicated.

BACKGROUND OF THE INVENTION

A common technique of industrial scale manufacturing of consumable filler metals is by continuously casting the weld filler alloy in the form, for example, of a rectangular bar. The continuous casting technique used for these products is by casting the bar on a casting wheel, often called a PROPERZI (trademark) wheel. The bar is subsequently in-line rolled to a round bar of about 8 to 10 mm diameter. Another common technique is the CONFORM (trademark) process, which is a continuous extrusion technique in which also a big rotating wheel is employed placed in line with a continuous casting facility to provide the feedstock for extrusion. The technique can be used as an alternative to the rolling process described above. For most welding wired the casting-rolling process is preferred over the casting-extrusion process because of the better metal quality with regard to the absence of processing contaminants such as grease.

The bars may be either directly coiled, or coiled after a rolling step, and then subsequently drawn to produce the weld filler wire of typical diameter.

Another method of industrial scale manufacturing of consumable filler metals is to cast an ingot of the weld filler alloy of predetermined chemical composition, extruding the ingot typically at elevated temperature, and afterwards the extruded rod may then be drawn into a wire. When used for welding aluminium alloys, the finished drawn wire has a diameter typically in the range of 0.5-6.0 mm.

However, these known techniques have been proven unsuitable for the production of certain weld filler metals, in particular those which become very brittle during a deformation operation possibly due to strain hardening and/or because of crack formation at elevated temperature during deformation operations due to the presence of low melting phases.

SUMMARY OF THE INVENTION

It is an object of the present invention to provide a method of manufacturing consumable filler metal which method can be applied to a much broader range of alloys.

In it another object of the present invention to provide a method of manufacturing consumable aluminium alloy filler metal having Mg as one of its constituents.

One or more of these objects are achieved by the method according to the invention of manufacturing a consumable filler metal, preferably in the form of wire, rod, or stick, and the like, of predetermined length and cross-section for use in a welding operation, preferably for welding an assembly of aluminium members, and wherein the method comprising the steps of:

providing an ingot of a first metal and inserts or bodies of one or more different further metals;

forming a composite compound (also termed a composite product) by providing the ingot of the first metal with one or more hollow cores or holes in substantially parallel relation to each other and the ingot axis and locating or providing into the hollow cores the inserts or bodies of the different further metal or metals;

applying pressure, and preferably at elevated temperature, to the composite compound to reduce its cross-section to a predetermined cross-section to form feedstock;

optionally further deforming the feedstock by means of mechanical pressure to form wire, rod or stick of final cross-section, so that the ultimate alloying stage of the first metal with the different further metal or metals is performed when the wire, rod or stick is used as filler material or consumable electrode during a welding operation.

With the method according to this invention different metals are metallurgically bonded together by means of the pressure or deformation process such that the desired or targeted alloy system is being obtained only at the ultimate welding step when using the final consumable wire, rod or stick, and the like. By effectively breaking or separating the final alloy system into two or more different alloy components is it possible to select the composition of the different components such that the combination is much easier to process and/or to deform than when a unitary alloy system was used from the beginning of the production process.

This allows for the processing of alloys which would otherwise be too hard or too brittle, such as for example aluminium alloys containing a substantial amount of Mg.

Furthermore, it allows for the processing of alloys which have low melting eutectic phases, and which would otherwise limit the processing in the conventional methods.

In addition, it allows for the processing of high alloyed metal systems which might otherwise form large intermetallic particles often having a high melting point (for example Cr and Zr-containing compounds in aluminium alloys, in particular in combination with the presence of considerable amounts of Mn) and which may end up in the weld or adversely affect the processing of the alloys during manufacturing. As the alloying system can now be separated, the formation of such large intermetallic particles or compounds can be avoided or at least significantly reduced.

DETAILED DESCRIPTION OF THE PREFERRED EMBODIMENTS

It will be evident for the skilled person that depending on the alloy system the ingot of the first metal can be provided with one hole or hollow core in which an insert or body of the second different metal is placed in coaxial relation to each other, or that the ingot of the first metal can be provided with multiple holes or hollow cores, preferably arranged at regular intervals from each other, in which holes inserts of the second metal can be placed. In the embodiment where there are provided multiple holes or hollow cores, more than one different metal can be used to arrive at the desired final alloy composition of the filler metal obtained at the ultimate welding step, for example a composite compound (also termed a composite product) made from an ingot of an AlMn-alloy with an insert of an Mg-alloy and an insert of an Al—Zr alloy to arrive at an Al—Mg—Mn—Zr filler system during the welding operation.

In an embodiment the diameter of the ingot of the first metal for forming the composite compound has a diameter in the range of 50 to 500 mm, and more preferably in a range of 100 to 350 mm.

The one or more hollow cores or holes in the ingot of the first metal can be obtained amongst others by machining or milling such as drilling into the ingot or by other mechanical operations, and by extruding an ingot of larger diameter to obtain an ingot or extrusion with one or more hollow cores, and by casting using regular casting techniques an ingot with a central hollow core, and by a combination of two or more of these techniques.

In an embodiment of the invention the pressure applied to the composite compound is by means of extrusion, which can be either direct or indirect extrusion. In another embodiment the pressure is applied by means of hydrostatic extrusion. Hydrostatic extrusion provides a much more even pressure onto the composite compound resulting in a much more homogeneous feedstock. Furthermore, the extrusion speed with hydrostatic extrusion can be much higher than with regular extrusion processes. And hydrostatic extrusion can be applied at lower temperatures compared to regular extrusion while still having economical extrusion speeds, and thereby allowing for the processing of metals causing otherwise eutectic melting at high temperatures.

In case an extrusion process is applied then the extrusion ratio preferably exceeds 60:1, and more preferably exceeds 80:1, and even more preferably exceeds 100:1 in order to improve the bond between the first and the second metal.

The resultant feedstock has typically a cross-sectional diameter in the range of 5 to 30 mm.

Preferably the further deforming of the feedstock is by means of drawing, more in particular by wire drawing, and where necessary by using multiple drawing steps. During the drawing operation an intermediate annealing may be employed depending on the alloy system. Depending of the alloy chemistry the drawn product may then be final annealed. And depending on the welding operation in which the resultant finished filler metal product is to be used, the surface may be cleaned for example by removing a thin fraction of the surface by planing as is known in the art. It has been found that for several alloying systems the wire drawing operation of the feedstock is much easier and faster compared to a wire of a unitary alloying system obtained via the conventional methods.

In case a drawing process is applied then the drawing reduction preferably exceeds 20%, and more preferably exceeds 30% in order to improve the bond between the first and the second metal.

The diameter of the finished wire, rod or stick, and the like, is typically in a range of 0.4 to 6.0 mm. The finished wire, rod or stick can be cut to any desired length or in the alternative coiled.

It is advisable to clean the surfaces of the cores and the bodies or inserts of the second metals which face each other prior to the deformation step, removing excessive oxidation, grease and the like. However, it is not usually necessary to thoroughly clean the surfaces, and normal layers of oxide forming during storage of the metal can usually be left without any deterioration of the bond between the first and the second metal being caused in the finished product.

In an embodiment of the method according to the invention the first metal is an aluminium alloy, and the resultant filler metal is to be used for welding aluminium alloy members.

In an embodiment of the method according to the invention at least one of the second metals is an aluminium alloy different from the first metal or is magnesium or is a magnesium alloy. It is to be understood that the second metal inserted into the hollow cores is made from a monolithic material and not from a metal powder or compacted flakes. Suitable forms of the second metal or metals are, for example, round rods, flat rods, hexagon rods or bars having a predetermined chemical composition.

In another embodiment at least one of the second metals in an Al—Zr alloy, and typically having Zr in a range of 0.2-4.0 wt. % as one of its constituents. Solidification of Zr as an alloying element takes places during the welding operation having significantly higher cooling rates compared to for example DC casting. The resultant is that more Zr can be added to the weld metal, if desired even above its normal solubility in aluminium, without the adverse formation of coarse intermetallic compounds.

A wide range of filler metals can be made using the method according to the invention, including weld filler metals which are regular in the art such as AA5183, AA5356, AA5556, AA5087, and AA5187, or modifications thereof.

In a preferred embodiment the alloy system obtained in the filler metal at the ultimate welding step is within a 5xxx aluminium filler alloy containing 4.0 to 10.0 wt. % Mg, preferably 5.0 to 9.0 wt. % Mg as one of its main constituents.

In a preferred embodiment the alloy system obtained in the filler metal at the ultimate welding step has a chemical composition, in wt. %:

| | |
|---|---|
| Mg | 5.5-9.5 |
| Mn | 0.6-2.0 |
| Zn | 0.2-1.6, and preferably 0.2-0.9 |
| Zr | ≦0.4, and preferably 0.05-0.3 |
| Cr | ≦0.5 |
| Sc | ≦2.8 |
| Cu | ≦0.5, preferably <0.15 |
| Fe | ≦0.5 |
| Si | ≦0.5 |
| Ti | ≦0.3, |

the balance aluminium and incidental elements and impurities, and typically each <0.05, total <0.15.

In a particular preferred embodiment of this filler metal, it comprises, in wt. %:

| | |
|---|---|
| Mg | 6.0-7.5, and preferably 6.2-7.5 |
| Mn | 0.9-2.0, and preferably 1.0-1.8 |
| Zn | 0.2-1.0, and preferably 0.3-0.9, |

and the other elements Zr, Cr, Sc, Cu, Fe, Si, Ti as described above.

In another particular preferred embodiment of the filler metal, it comprises, in wt. %:

| | |
|---|---|
| Mg | 7.0-9.5, and preferably 7.5-8.5 |
| Mn | 0.9-1.45, and preferably 0.9-1.25 |
| Zn | 0.2-1.0, and preferably 0.3-0.9, |

and the other elements Zr, Cr, Sc, Cu, Fe, Si, Ti as described above.

In another embodiment the alloy system obtained in the filler metal at the ultimate welding step is within a 7xxx aluminium filler alloy containing 4.0 to 9.0 wt. % Zn, preferably 4.0 to 5.5 wt. % Zn as one of its main constituents, and preferably with Mg as other main constituent in a range of less than 5.0 wt. % Mg, and preferably in a range of 0.5 to 2.0 wt. % Mg. When used for welding 7xxx-series alloy members, the Cu content in the filler metal is preferably less than 0.5 wt. %.

In another embodiment the alloy system obtained in the filler metal at the ultimate welding is within the Al—Li alloy systems containing 0.4 to 4.0 wt. % Li.

In another aspect the invention relates to the use of the consumable filler metal obtained by the method according to this invention for welding an assembly of members at least one of the members being made of an aluminium alloy selected from the group consisting of 5xxx-series, 6xxx-series and 7xxx-series alloys.

And in a preferred embodiment at least one of the members has a composition, in wt. %:

| | |
|---|---|
| Mg | 4.0-6.2, and preferably 4.7-5.6 |
| Mn | 0.3-1.4, preferably 0.4 to 1.2, and more preferably 0.6-1.1 |
| Zn | 0.25-1.5, preferably 0.25-0.80, and more preferably 0.30-0.65 |
| Zr | 0.05-0.30 |
| Cr | 0.3 max. |
| Ti | 0.2 max. |
| Fe | 0.5 max., and preferably 0.25 max. |
| Si | 0.5 max., and preferably 0.25 max. |
| Cu | 0.25 max., and preferably 0.10 max. |
| Sc | 0.5 max., |

the balance essentially aluminium and incidental elements and impurities, and typically each <0.05, total <0.15.

The consumable filler metal obtained by the method according to this invention can be used also for welding an assembly of members at least one of the members being a cast product or a foundry product, for example a sand-cast or pressure die-cast product, and preferably having a composition selected from the group consisting of 3xx-, 4xx-, 5xx-, 6xx- and 7xx-series alloys.

The invention will now be illustrated with reference to a non-limiting embodiment according to the invention.

EXAMPLE

On an industrial scale an extrusion billet of an aluminium alloy has been DC-cast having, after scalping, a diameter of 160 mm. The alloy was a modified 3xxx-series alloy which was very easy to cast. The ingot was provided at its center by means of drilling with one hole of 52.0 mm diameter. In this hole a rod was placed having a diameter of 51.8 mm and a similar length as the ingot to form a composite compound (also termed a composite product).

The billet and the insert substantially have the alloy elements of the alloy composition summarized in Table 1. The rod was from the commercially available AZ31 magnesium alloy. For both products the Fe and Si-contents were within conventional ranges. The composite compound had been successfully hydrostatically extruded at a temperature of about 250° C. into feedstock of 10 mm diameter. The feedstock was wire drawn to MIG (metal inert gas) weld filler wire of 1.2 mm diameter. The final composition of the weld filler wire is also given in Table 1. This filler wire has been used successfully to MIG weld assemblies of AA5059 plate material.

Also, It had been tried to DC-cast an extrusion ingot of similar thickness as mentioned above and having the final composition as a unitary alloy of the weld filler metal as listed in Table 1. This resulted in excess burn-off of magnesium in the casting furnace, strong macro-segregation of alloying elements across the diameter of the cast ingot, very poor surface quality such that substantial amounts of the ingot had to be scalped, and strong crack formation during the extrusion operation. This production route was found to be very unattractive to produce in a reliable, consistent and economical attractive manner weld filler wires having a high Mg content.

The same alloy composition has been cast via a continuous casting technique followed by the CONFORM (trademark) extrusion technique, but which appeared impossible. At low casting speeds the aluminium alloy was too cold and consequently too hard and could not be taken off the casting wheel. In the subsequent extrusion step the alloy appeared to be too hard to be processed and heating of the material during deformation caused eutectic melting. It is said that aluminium alloys with more than 5.4 wt. % of Mg cannot be processed via this technique neither via the alternative continuous casting-rolling technique.

TABLE 1

| | Principal alloying elements, in wt. % | | | | |
|---|---|---|---|---|---|
| Product form | Mg | Mn | Zr | Zn | Al |
| Ingot | 0.14 | 1.06 | 0.13 | 0.68 | balance |
| Rod | balance | 0.3 | — | 1 | 3 |
| Filler | 7.0 | 1.0 | 0.12 | 0.7 | balance |

Having now fully described the invention, it will be apparent to one of ordinary skill in the art that many changes and modifications can be made without departing from the spirit or scope of the invention as herein described.

The invention claimed is:

1. Method of manufacturing a consumable filler metal in the form of wire, rod, or stick, of predetermined length and cross-section for use in a welding operation, comprising the steps of:

providing an ingot of a first aluminium alloy and inserts or bodies of a second metal different from the first aluminium alloy;

forming a composite product by providing the ingot of the first aluminium alloy with one or more hollow cores in substantially parallel relation to each other and locating in the hollow cores the second metal wherein the second metal is made of monolithic material;

applying pressure to the composite product to reduce its cross-section to a predetermined cross-section to form feedstock;

deforming the feedstock by means of mechanical pressure to form wire, rod or stick, of final cross-section so that the ultimate alloying stage of the first aluminium alloy with the second metal is performed when the wire, rod or stick is used as filler material or consumable electrode during a welding operation.

2. Method according to claim 1, wherein applying pressure to the composite product is by means of extrusion.

3. Method according to claim 1, wherein applying pressure to the composite product is by means of hydrostatic extrusion.

4. Method according to claim 1, wherein applying pressure to the composite product is by means of extrusion with an extrusion ratio exceeding 60:1.

5. Method according to claim 1, wherein applying pressure to the composite product is by means of hydrostatic extrusion with an extrusion ratio exceeding 60:1.

6. Method according to claim 1, wherein applying pressure to the composite product is by means of hydrostatic extrusion with an extrusion ratio exceeding 80:1.

7. Method according to claim 1, wherein applying pressure to the composite product is by means of hydrostatic extrusion with an extrusion ratio exceeding 100:1.

8. Method according to claim 1, wherein the further deforming of the feedstock is by drawing using a drawing reduction of at least 20%.

9. Method according to claim 1, wherein the further deforming of the feedstock is by drawing using a drawing reduction of at least 30%.

10. Method according to claim 1, wherein the second metal is an aluminium alloy different from the first aluminium alloy.

11. Method according to claim 1, wherein the second metal is magnesium or a magnesium alloy.

12. Method according to claim 1, wherein the second metal is an Al—Zr alloy.

13. Method according to claim 12, wherein the second metal is an Al—Zr alloy having Zr in a range of 0.2 to 4.0%.

14. Method according to claim 1, wherein the ingot of the first aluminium alloy has a diameter in a range of 50 to 500 mm.

15. Method according to claim 1, wherein the feedstock has a cross-sectional diameter in the range of 5 to 30 mm.

16. Method according to claim 1, wherein the final cross-section of the filler material or consumable electrode is in a range of 0.4 to 6.0 mm.

17. Method according to claim 1, wherein the final filler metal is a 5xxx-series aluminium alloy comprising 4 to 10 wt. % Mg.

18. Method according to claim 17, wherein the final filler metal is a 5xxx-series aluminium alloy comprising 5 to 9% Mg.

19. Method according to claim 1, wherein the final filler metal has a chemical composition within the range of alloys selected from the group comprising AA5183, AA5356, AA5556, AA5087, and AA5187.

20. Method according to claim 1, wherein the final filler metal has the following composition, in wt. %,

| | |
|---|---|
| Mg | 6.0-9.5 |
| Mn | 0.6-2.0 |
| Zn | 0.2-1.6 |
| Zr | ≦0.4 |
| Cr | ≦0.5 |
| Sc | ≦2.8 |
| Cu | ≦0.5 |
| Fe | ≦0.5 |
| Si | ≦0.5 |
| Ti | ≦0.3, |

the balance aluminium and incidental elements and impurities.

21. Method according to claim 20, wherein the final filler metal has a Zn-content in the range of 0.2 to 0.9%.

22. Method according to claim 20, wherein the final filler metal has a Zn-content in the range of 0.3 to 0.9%.

23. Method according to claim 20, wherein the final filler metal has a Zr-content in the range of 0.05 to 0.3%.

24. Method according to claim 20, wherein the final filler metal has Mg-content in the range of 6.0 to 7.5%.

25. Method according to claim 20, wherein the final filler metal has Mg-content in the range of 6.2 to 7.5%.

26. Method according to claim 20, wherein the final filler metal has Mg-content in the range of 7.0 to 9.5%.

27. Method according to claim 20, wherein the final filler metal has Mg-content in the range of 7.5 to 8.5%.

28. Method according to claim 20, wherein the final filler metal has Mn-content in the range of 0.9 to 2.0%.

29. Method according to claim 20, wherein the final filler metal has Mn-content in the range of 0.9 to 1.45%.

30. Method according to claim 20, wherein the final filler metal has Mn-content in the range of 0.9 to 1.25%.

31. Method according to claim 20, wherein the final filler metal has Mn-content in the range of 1.0 to 1.8%.

32. Method according to claim 1, wherein the final filler metal is a AA7xxx-series aluminium alloy comprising 4.0 to 9.0 wt. % Zn.

33. Method according to claim 32, wherein the final filler metal is a AA7xxx-series aluminium alloy comprising 4.0 to 5.5% Zn.

34. Method according to claim 32, wherein the final filler metal is a AA7xxx-series aluminium alloy comprising 4.0 to 9.0 wt. % Zn and further 5.0 wt. % or less of Mg.

35. Method according to claim 32, wherein the final filler metal is a AA7xxx-series aluminium alloy comprising 4.0 to 9.0 wt. % Zn and further 0.5 to 2.0 wt. % Mg.

36. Method according to claim 1, wherein the final filler metal is an Al—Li alloy containing 0.4 to 4.0 wt. % Li.

37. Method of making an assembly comprising welding a consumable filler metal product made by the method of claim 1 and then welding said filler metal product with at least one aluminium alloy selected from the group consisting of AA5xxx-series, AA6xxx-series and AA7xxx-series alloys.

38. Method of claim 37, wherein the alloy has a composition of, in wt. %:

| | |
|---|---|
| Mg | 4.0-6.2 |
| Mn | 0.3-1.4 |
| Zn | 0.25-1.5 |
| Zr | 0.05-0.30 |
| Cr | 0.3 max. |
| Ti | 0.2 max. |
| Fe | 0.5 max. |
| Si | 0.5 max. |
| Cu | 0.25 max. |
| Sc | 0.5 max., |

the balance essentially aluminium and incidental elements and impurities.

39. Method of claim 38, wherein the alloy has incidental elements and impurities in a range of each <0.05, total <0.15.

40. Method of claim 38, wherein the alloy has a Mg-content in a range of 4.7 to 5.6%.

41. Method of claim 40, wherein the alloy has a Mn-content in a range of 0.4 to 1.2%.

42. Method of claim 41, wherein the alloy has a Zn-content in a range of 0.25 to 0.80%.

* * * * *